US005219295A

United States Patent [19]

Niwa et al.

[11] Patent Number: 5,219,295

[45] Date of Patent: Jun. 15, 1993

[54] ELECTRICAL CONNECTOR WITH GUIDE MEMBER

[75] Inventors: Takeo Niwa, Kawasaki; Yoshitsugu Fujiura, Tokyo; Shigeru Ishikawa, Hachioji, all of Japan

[73] Assignee: AMP Incorporated, Harrisburg, Pa.

[21] Appl. No.: 857,206

[22] Filed: Mar. 25, 1992

[30] Foreign Application Priority Data

Mar. 25, 1991 [JP] Japan ..... 3-83010

[51] Int. Cl.[5] ..... H01R 9/09

[52] U.S. Cl. ..... 439/79

[58] Field of Search ..... 439/55, 78, 79, 80, 439/629, 630

[56] References Cited

U.S. PATENT DOCUMENTS

| | | | |
|---|---|---|---|
| 4,054,345 | 10/1977 | Sherwood | 439/79 X |
| 4,986,772 | 1/1991 | Fukutani | 439/79 X |
| 5,090,116 | 2/1992 | Henschen et al. | 439/79 X |
| 5,104,326 | 4/1992 | Smith et al. | 439/79 X |

*Primary Examiner*—Steven C. Bishop
*Assistant Examiner*—Khiem Nguyen
*Attorney, Agent, or Firm*—Adrian J. LaRue; Timothy J. Aberle

[57] ABSTRACT

A high density electrical connector includes an insulating housing having contacts arranged in rows to engage the contacts of a mating connector, or first printed circuit board, with the contacts having ends extending in freestanding relationship relative to the housing and including a guide member having beveled surfaces to guide the free ends of the contacts into alignment with holes of a second printed circuit board to facilitate mounting of the connector housing and contacts on the second printed circuit board. Embodiments include a guide member which divide at least one row of contacts into two rows and a guide member which guide four rows of contacts into rows of holes in the printed circuit board. The invention contemplates particularly right angle connectors having contacts wherein the freestanding ends are on slightly different centers.

4 Claims, 3 Drawing Sheets

ELECTRICAL CONNECTOR WITH GUIDE MEMBER

This invention relates to a high density electrical connector of a type mounted on a printed circuit board including, particularly, a right angle connector having closely spaced terminals.

BACKGROUND OF THE INVENTION

The process of miniaturization of electronic components has led to an ever increasing density of the electrical terminals which carry power and signal voltage levels between the circuits of such components. Packaging, which features an interconnection of intercomponents through rigid or flexible printed circuit boards, finds arrays of electrical terminals mounted in rows on centers of 1 mm or less. Connectors utilized to provide interconnections thus require terminals to be mounted on such spacings, and the characteristics of such connectors utilizing contact posts that are inserted in the holes in printed circuit boards or the like can make assembly tedious, difficult, and costly.

One approach to solving this problem has been the utilization of guide members of insulating material having on one side apertures aligned with the holes in a printed circuit board or the like, and on the other side, holes or surfaces tapered to facilitate the insertion of the ends of terminals, posts, or the like, into the guide member to facilitate mounting of a connector on a printed circuit board with the terminals properly aligned for subsequent solder. The foregoing problem is particularly found with the fragile terminal posts necessary to have the close centers above-mentioned, and also with respect to the so called right angle connectors where the terminals are bent essentially at right angles to be inserted in the printed circuit board. A related problem has to do with the use of terminals in a connector having spacings to suit a particular miniaturization for intermating with mating connectors and also having to mate with printed circuit boards having holes on different spacings.

Accordingly, it is an object of the present invention to provide an electrical connector of the type having closely spaced terminals to provide a high density interconnection to other mating connectors and also to printed circuit boards and the like. It is a further object of the invention to provide an electrical connector of the high density type wherein terminal ends on given centers can be guided through the provision of a guide member to different centers. Still a further object is to provide a connector, including a guide member facilitating the insertion of terminals having ends varying in center spacing through guiding such ends into precise spacing for mounting on printed circuit boards. A final object is to provide an electrical connector facilitating the ready assembly of a high density array of terminals onto a printed circuit board.

SUMMARY OF THE INVENTION

The present invention features an electrical connector of a type having terminals on close centers intended to be inserted in the holes in a printed circuit board to provide an interconnection from a mating connector to such printed circuit board, particularly with respect to right angle connectors of the high density type. The invention includes a plastic housing having terminals mounted therein with one end of the terminals arrayed in rows to engage and connect with the terminals of a mating connector or a printed circuit board plugged into the invention connector and interconnect such terminals to the circuits of a printed circuit board. The connector of the invention is mounted on the printed circuit board through soldering or the like, utilizing a guide member which may be attached to the connector housing, the guide member having apertures therein which match the holes in a printed circuit board on one side of the member, and on the other side of the member contain beveled surfaces that guide the ends of the terminals into the member for alignment and installation on a printed circuit board.

In one embodiment, the invention includes a guide member having apertures therein and beveled surfaces that divide the terminals of a given row of the connector into two rows and in another embodiment, the guide member includes a step-like arrangement with rows of apertures at different levels of the member and with sets of guide surfaces. One set of guide surfaces includes beveled surfaces that align the ends of terminal posts in a sense transverse to the action of insertion of the posts and the other set of surfaces align the ends of the posts along the insertion axis. The latter embodiment facilitates a ready assembly of freestanding terminals in rows from a housing first into the apertures of the guide member and then through the guide member into the holes of a printed circuit board. The invention contemplates a utilization with connectors having a single row of terminals for intermating with further connectors split into a double row for mounting on a printed circuit board, or multiple rows of intermating terminals guided into multiple rows suitable for mounting on a printed circuit board.

IN THE DRAWINGS

DETAILED DESCRIPTION OF THE INVENTION

Figure 8:
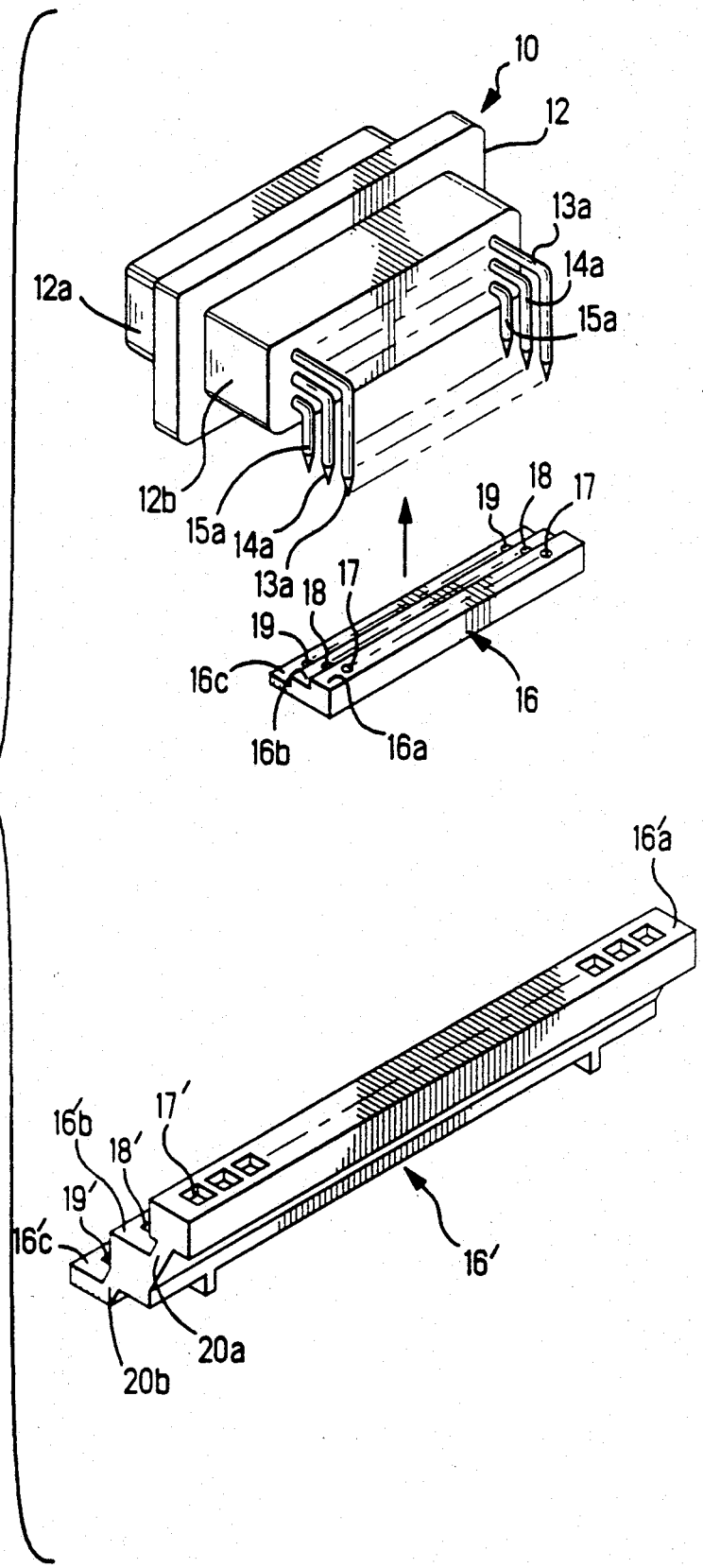
FIG. 8 Prior Art
FIG. 8 is a view of two embodiments of the prior art.

Turning first to the prior art representation shown in FIG. 8, a right angle connector 10 includes a housing 12 having a number of terminals 13*a*–15*a* and a guide member 16 separated from connector 10 and prior to assembly of the guide member to the housing. The connector 10 represents a variety of connectors having plastic housings, including a front face 12*a* that mates with a mating connector, and a rear portion 12*b* that has a number of terminals extending therefrom, the terminals typically being stamped and formed of copper-based alloys to include posts, round or square, tapered at the ends and necessarily interconnected with circuits on a printed circuit board, not shown. Problems arise in that the terminals 13a–15a, through inventory, handling, or accident get deformed from the initial geometry of manufacture so that the ends of the terminals are no longer aligned sufficiently to be inserted into the array of holes of a printed circuit board. Attempts to assemble connector 10 onto a printed circuit board can be frustrated if a single one of the terminals 13a–15a is misaligned beyond the tolerance accepted by the holes in the board. Considering that the terminals may be on centers as small as 1 mm, the problem is a considerable one. As one solution, a guide member 16 in FIG. 8 is utilized, made of plastic material, to include a number of steps 16a–16c containing an array of apertures 17, 18, and 19 arranged in three rows extending across the guide member in positions to receive the ends of terminals 13a–15a and align them to facilitate insertion into a printed circuit board. The lower portion of FIG. 8 shows an alternative embodiment, including a guide member 16' having a series of rows of 17', 18', and 19' arranged in a series of steps 16'a, 16'b, and 16'c. The steps are interconnected by inclined sections 20a and 20b and the holes have tapered surfaces to facilitate insertion of the ends of terminals such as 13a–15a into the holes of the guide member 16'. These attempts of the prior art, while helping in the assembly of high density connectors, and particularly right angle connectors, have not been found to solve the problem completely of the insertion of very small, fragile terminals arrayed on closely spaced centers due to the stubbing of terminal ends caused by misalignment of the terminals.

The present invention seeks to overcome these limitations through two different embodiments.

Figure 1:
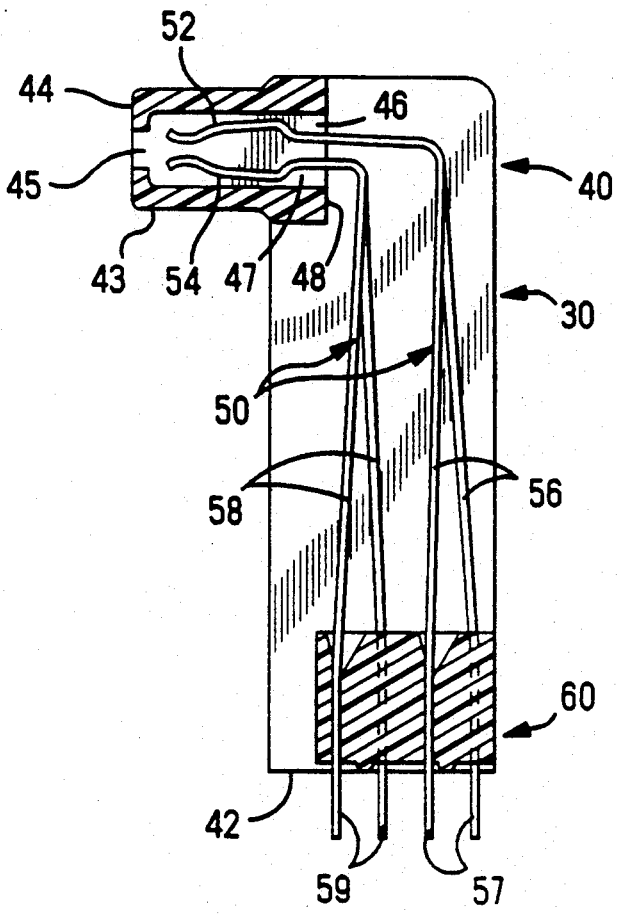
FIG. 1 is a side, elevational and partially sectioned view showing one embodiment of the invention, including a connector, terminals, and guide member.

The first embodiment is shown in FIG. 1, which may be taken to be analogous to the prior art teaching, in terms of housing and guide member, but which is different in the sense that it splits a row of contacts in the housing portion of the connector into two rows through engagement with the guide member. The connector is shown as 30 to include a housing 40 having a lower surface 42 that engages the printed circuit board and a forward end 43 having a surface 44 that engages a mating connector or serves to receive the insertion of a printed circuit board carrying contacts that intermate with connector 30. An aperture 45 is provided for the insertion of either contacts or a printed circuit board. The forward end of connector 30 includes rows of apertures or passages 46 and 47, each receiving contacts 50 that include spring contact sections 52 and 54 on one end of the contacts 50 and further include tails or legs 56 and 58 extending therefrom, at right angles in the embodiment shown, and terminating at second ends 57 and 59 that fit into the holes of a printed circuit board.

To be noted in FIG. 1 is that the two rows of contacts 50, the row extending in passages 46 and the row extending in passages 47 are divided and split into four rows through the guide member 60. The contacts 50 thus are, as formed, in side-by-side relationship in two rows extending downwardly at right angles from the forward end 43.

Figure 3:
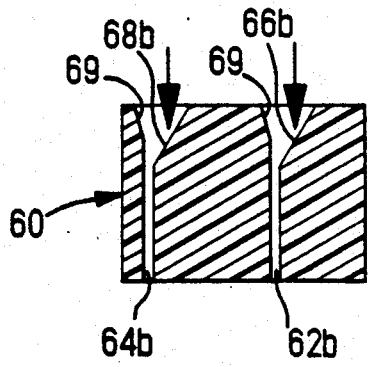
FIG. 3 is a side, elevational, and sectional view taken through lines 3—3 of FIG. 2.
Figure 4:
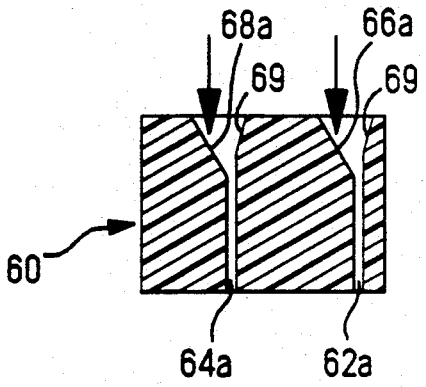
FIG. 4 is a side, elevational, and sectional view taken through lines 4—4 of FIG. 2.
Figure 2:
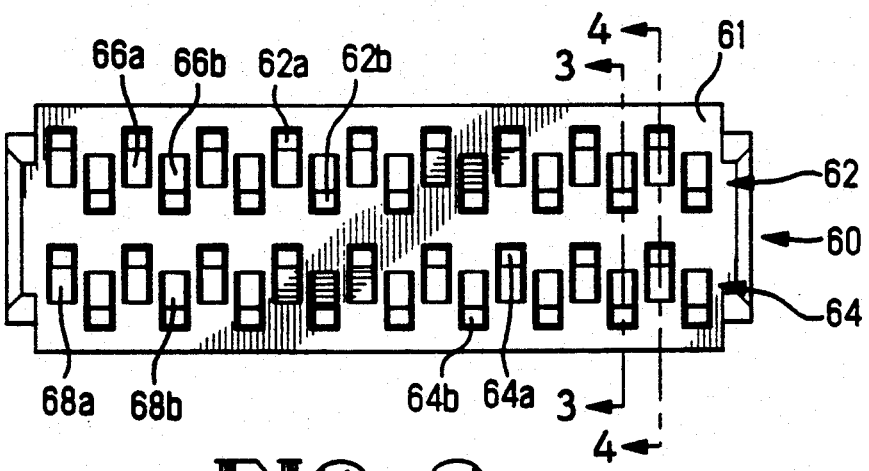
FIG. 2 is a plan view of the guide member shown in FIG. 1 from the top.

FIG. 2 shows the guide member 60, of a molded plastic configuration, to include an upper surface 61 having two rows of apertures 62 and 64 that each split into two rows of apertures 62a, 62b and 64a, 64b, extending through the guide member 60 to be aligned with holes in a printed circuit board. FIGS. 3 and 4 show the apertures to include beveled surfaces 66a, 66b, 68a, and 68b, each opposite beveled surface 69 and both beveled surfaces leading to the apertures 62a, 62b, 64a, and 64b extending through the guide member. As can be seen from the arrows shown in FIGS. 3, and 4, the ends 57 and 59 of the contacts 30 enter through the apertures of rows 62 and 64, engage the beveled surfaces, particularly the longer sloped surfaces such as 66a, 66b and 68a, 68b and are guided to extend through the apertures such as 62a, 62b, and 64a, 64b.

The ends 57 and 59 of the contacts may very well have been manufactured or produced to reside on specific dimensions, considering tolerances, adequate to fit in holes of a printed circuit board, but may have been deformed in inventory, handling, and use in assembly such that one or more of the ends stub when an attempt is made to insert them in the printed circuit board holes. The guide member 60 thus serves to align the ends 57 and 59 precisely with respect to holes in the printed circuit board. Moreover, the guide member 60 and the apertures, functioning as described, serve to take contacts 56 or 58 which each being in a single row as manufactured, and deflect such contacts so as to gather the ends 57 or 59 thereof and drive them laterally of the action of axis of insertion into two separate rows, thus converting two rows of contacts 56 and 58 into four rows of contacts having ends 57 and 59 as shown in FIG. 1. The guide member 60 thus doubles the center to center spacing of a given row of the connector, making it possible to place contacts on given centers in the connector compatible with contacts of different and larger center spacings on a printed circuit board as well as aligning all of the contacts for easy insertion into the holes of a printed circuit board.

As should be apparent and as should be appreciated, the connector of FIGS. 1–4 could have a single row of contacts, rather than the two rows shown, or could have more rows of contacts than the two rows shown, to the same advantage and improvement in deflection of contacts and of alignment for insertion in printed circuit board.

Figure 5:
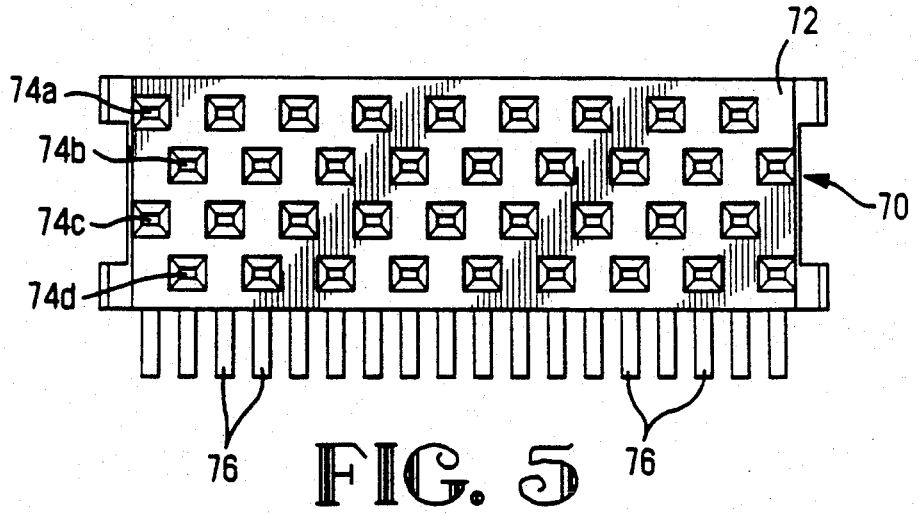
FIG. 5 is a front, elevational view of an alternative embodiment of the housing of the connector of the invention.
Figure 6:
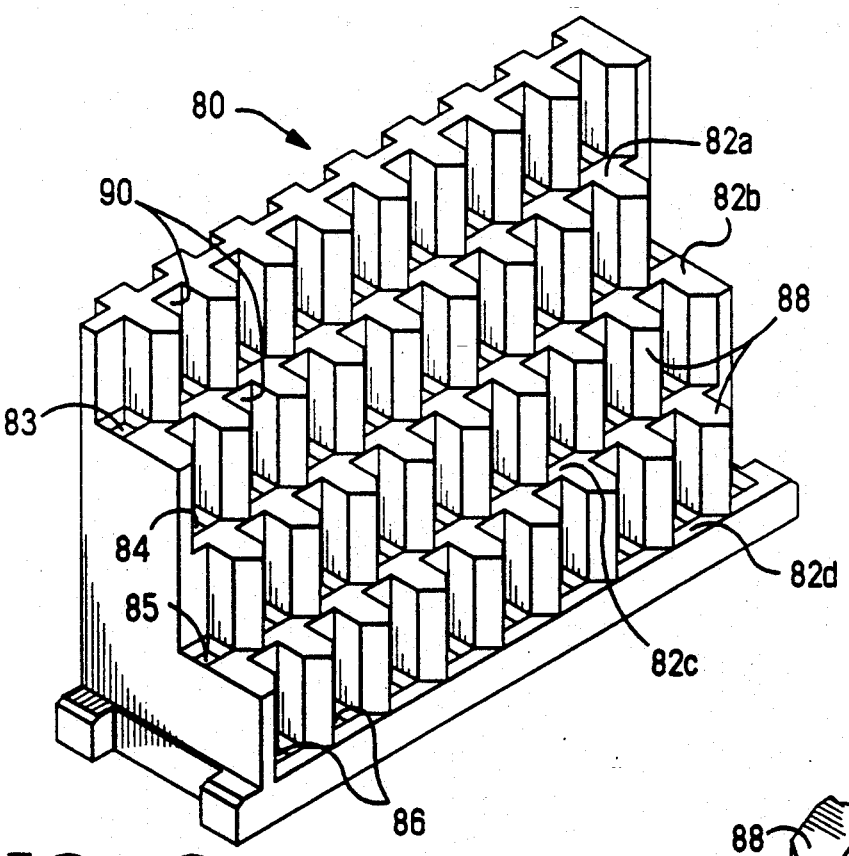
FIG. 6 is a perspective of the guide member associated with the connector housing shown in FIG. 5.
Figure 7:
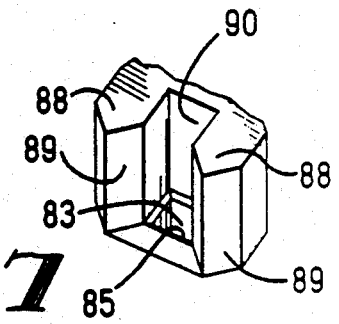
FIG. 7 is a perspective of one aperture, including beveled surfaces related to the guide member shown in FIG. 6.

Referring now to FIGS. 5–7, details are shown of an alternative embodiment of the invention, including a connector 70 having a housing 72 including four rows of contacts, each having ends such as 74a–74d projecting therefrom and further or second ends 76 projecting downwardly at right angles to the axis of the ends 74a–74d. The contacts 74a–74d would intermate with a connector having contacts or terminals on centers in four rows, the contacts of adjacent rows being offset as shown in FIG. 5. The second ends 76 would fit into the holes of a printed circuit board and be soldered to thus provide an interconnection between the circuit traces on the board and a mating connector engaging connector 70 in a manner well known but not shown.

FIG. 6 shows a guide member 80 formed of molded plastic construction to include a series of steps 82a–82d, offset and made to include a series of apertures 83–86 that extend through the guide member 80. Housing 72 would have a rear geometry complementary to the guide member 80.

FIG. 7 shows details of one of the apertures 83. Beveled surfaces 85 lead to apertures 83 and an interior wall 90 extends parallel to the axis of insertion through the aperture 83 and further walls 88 having pointed or beveled ends 89 extend normal to wall 90. The apertures 83–86 are aligned with the spacing of the second ends 76 in turn aligned with the different rows of contacts 74a–74d. The rear surface of the connector housing associated with connector 70 is sloped or beveled to fit against the guide member 80 shown in FIG. 6. The ends 76 are, during assembly of housing 72 to guide member 80, made to approach the guide member, obliquely or in an arcuate sense, so that the ends 76 first enter between the tapered surfaces 89 of the walls 88 to strike the walls 90 and then, with rotation, are guided down to engage the beveled surfaces 85 and enter into the appropriate apertures 83–86. In this manner, displacement of the second ends 76 of the contacts, through accident or otherwise, can be accommodated in X and Y senses, an X sense representing a lateral displacement relative to the plane of the printed circuit board, and a Y sense represented in the axis of insertion into the printed circuit board.

In other words, the disposition of the various sets of beveled surfaces, beveled surfaces 89 on walls 88 and beveled surfaces 85 surrounding the apertures of the guide member receive the second ends of the contacts and guide them in engagement, aligning the terminals precisely for insertion in the printed circuit board and accommodating the multiple rows, the four rows as shown despite slight variations in the placement or spacing of the contact ends.

The invention contemplates the use of both of the embodiments heretofore described, the intermixing of embodiments in details and the use of as few as one row of contacts, separated by one embodiment guide member of FIGS. 1–4, or four or more rows accommodated in a manner disclosed in the guide member of FIGS. 5–7.

For a full appreciation of the invention, the contacts accommodated are extremely small and relatively fragile being on pitches on the order of 1 mm or less, and then a particular embodiment, such as the guide member 60, through a guide member of a thickness on the order of 6 mm with guide surfaces such as 66 and 68 being on the order of 2.5 mm, slanted at about 30 degrees, representing the bevel, with apertures roughly 0.4 mm wide. The invention fully contemplates that the connector housings such as 40 or 70 may include details to latch to the guide members 60 and 80 to form an assembly readily mounted on a printed circuit board with the second ends of the contacts in two or more rows.

Having now described the invention through the foregoing specification and appended drawings, claims are set forth hereinbelow to define what is asserted as inventive.

We claim:

1. A high density electrical connector for intermating circuit paths to a further connector including an insulating housing and at least one row of contacts mounted therein having first and second ends, the housing positioning the first ends of the contacts on a predetermined center to center spacing for being resiliently engaged by mating contact surfaces of the further connector, the second ends of the contacts being initially positioned in a free standing relationship extending along a given axis in one row, an insulating guide member including beveled surfaces leading to apertures extending therethrough along said given axis and arranged in side by side relationship in at least two rows, the beveled surfaces engaging the contact second ends to guide adjacent second ends of the contacts inserted along the given axis from one row into separate rows to alter the side to side spacing of the second ends for insertion into the apertures of a printed circuit board, and wherein said beveled surfaces of adjacent apertures include oppositely oriented surfaces to guide adjacent second ends of the contacts in two rows apart relative to the given axis.

2. The connector of claim 1 wherein said first ends of the contacts include two rows of contacts and said second ends of contacts include initially two rows of contacts with said insulating guide member having four rows of apertures to guide the second ends for insertion into the apertures of the printed circuit board through engagement by said beveled surfaces on said guide means.

3. The connector of claim 1 wherein said beveled surfaces are disposed on the order of 30 degrees relative to the given axis of insertion of the second ends.

4. The connector of claim 1 wherein said first and second ends are oriented at right angles to each other to provide a right angle connector.

* * * * *